US005556331A

United States Patent [19]

Bastian

[11] Patent Number: 5,556,331

[45] Date of Patent: Sep. 17, 1996

[54] FUME HOOD WITH AIR FOIL MEMBER

[75] Inventor: John M. Bastian, Manitowoc, Wis.

[73] Assignee: Fisher Hamilton Scientific Inc., Two Rivers, Wis.

[21] Appl. No.: 371,948

[22] Filed: Jan. 20, 1995

[51] Int. Cl.[6] ..... B08B 15/02

[52] U.S. Cl. ..... 454/56; 312/209; 312/229

[58] Field of Search ..... 454/49, 56, 61, 454/62; 312/209, 229

[56] References Cited

U.S. PATENT DOCUMENTS

| | | | |
|---|---|---|---|
| 2,702,505 | 2/1955 | Nelson | 454/62 |
| 3,874,754 | 4/1975 | Saunders et al. | 454/56 X |
| 4,023,473 | 5/1977 | Russell . | |
| 4,280,400 | 7/1981 | Longworth . | |
| 4,409,890 | 10/1983 | Longworth . | |

FOREIGN PATENT DOCUMENTS

| | | | |
|---|---|---|---|
| 337469 | 10/1989 | European Pat. Off. | 454/49 |
| 0486971 | 5/1992 | European Pat. Off. | 454/56 |

*Primary Examiner*—Harold Joyce
*Attorney, Agent, or Firm*—Tilton, Fallon, Lungmus & Chestnut

[57] ABSTRACT

A fume hood includes a base, sidewalls and a cover that define an enclosed work space, a work surface, at least one trough, and an access opening. The fume hood also includes a moveable sash for closing the opening and an air foil disposed proximate an edge portion of the opening to direct air flow through the opening and into the work space. This air foil includes a flat portion with a surface that normally lies flush with the work surface of the fume hood.

13 Claims, 2 Drawing Sheets

20
18
19
16
17
26
23
28
22
22b
22d
22a
24
22e
25
22c
27

FUME HOOD WITH AIR FOIL MEMBER

BACKGROUND OF THE INVENTION

1. Field of the Invention

The present invention relates to a fume hood apparatus, and more particularly to a fume hood apparatus with an air foil member which facilitates the cleaning of the area proximate the fume hood work surface using air flowing into the fume hood.

2. Description of the Prior Art

Fume hoods are protective enclosures which provide ventilated and illuminated work spaces for laboratory or other applications. They typically include a housing and a fan for drawing air and toxic fumes from the housing for safe discharge. The housing includes an opening which allows access to the work space. Air enters the fume hood through this opening to replace the air discharged by the fan. A problem with prior fume hoods is that they do not include means for effectively removing fumes and other material which have settled on or proximate the work surface of the fume hood.

Unlike prior fume hoods, the fume hood of the present invention is a simple construction that includes an air foil member for directing air along the fume hood's work surface to effectively evacuate the surface and the work space of fumes and other waste materials. This fume hood minimizes the expense of manufacture and assembly. It includes a small number of components which provide an effective well-ventilated work space.

SUMMARY OF THE INVENTION

In accordance with this invention, a fume hood apparatus includes a housing with sidewalls, a cover, and a base member that defines a substantially flat work surface. The base member, sidewalls, and cover define an enclosed work space and an access opening to that work space. A moveable sash closes the opening, and an air foil member disposed along an edge of the opening directs air flow through the opening and along the work surface of the work space.

The air foil member extends the length of the opening and includes a flat portion. It is moveable between a first position in which the flat portion extends generally inward of the work space and includes a surface that lies flush with the work surface and a second position in which the flat portion extends away from the work space.

The base member includes a substantially horizontal top segment which defines the work surface and trough means for collecting liquid flowing off the work surface. The trough means includes an elongate trough disposed along the opening of the apparatus below the flat portion of the air foil member when the air foil lies in the first position.

BRIEF DESCRIPTION OF THE DRAWINGS

For a more complete understanding of this invention, one should now refer to the embodiment illustrated in greater detail in the accompanying drawings and described below by way of an example of the invention. In the drawings.

While the following disclosure describes the invention in connection with one embodiment, one should understand that the invention is not limited to this embodiment. Furthermore, one should understand that the drawings are not to scale and that graphic symbols, diagrammatic representatives, and fragmentary views, in part, illustrate the embodiment. In certain instances, the disclosure may not include details which are not necessary for an understanding of the present invention such as conventional details of fabrication and assembly.

DETAILED DESCRIPTION OF THE DRAWINGS

Figure 1:
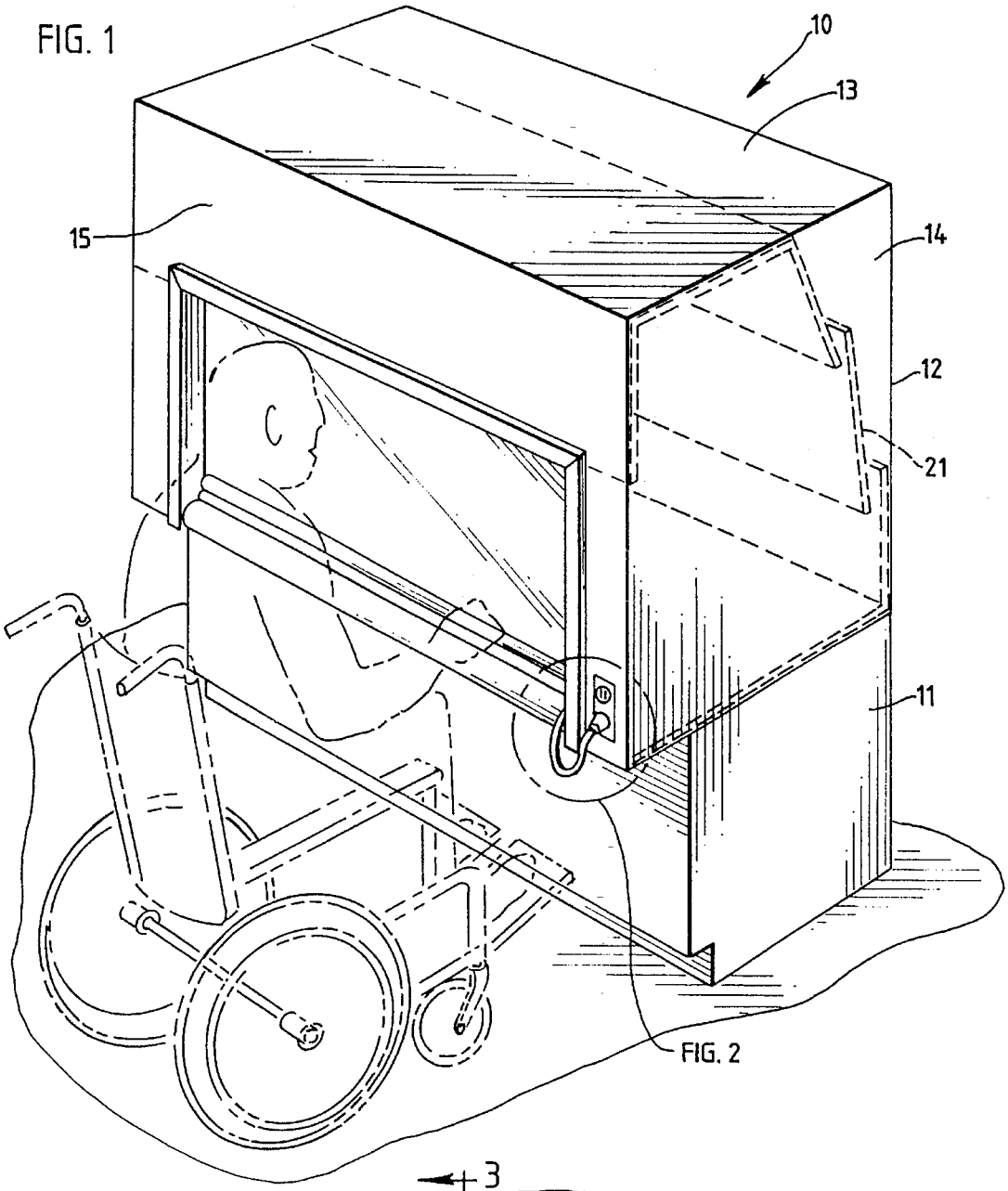
FIG. 1 is a perspective view of the fume hood apparatus of the present invention.
Figure 2:
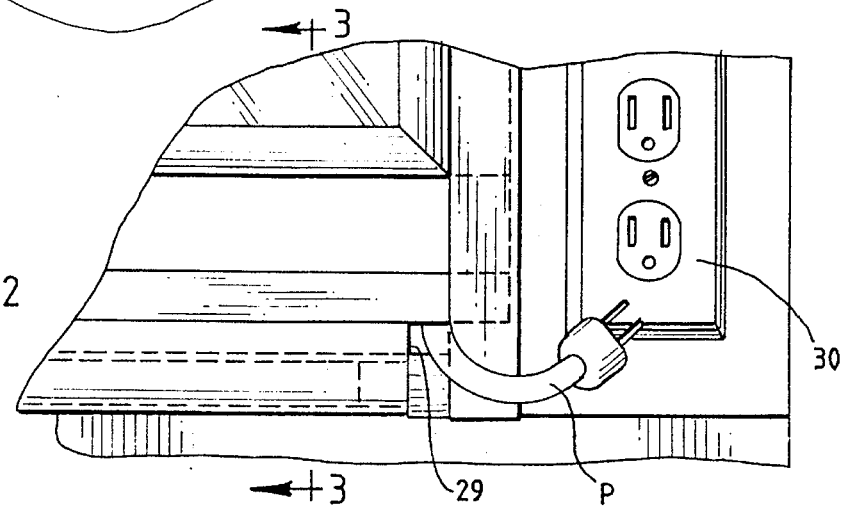
FIG. 2 is an enlarged detail view of detail A in FIG. 1.
Figure 3:
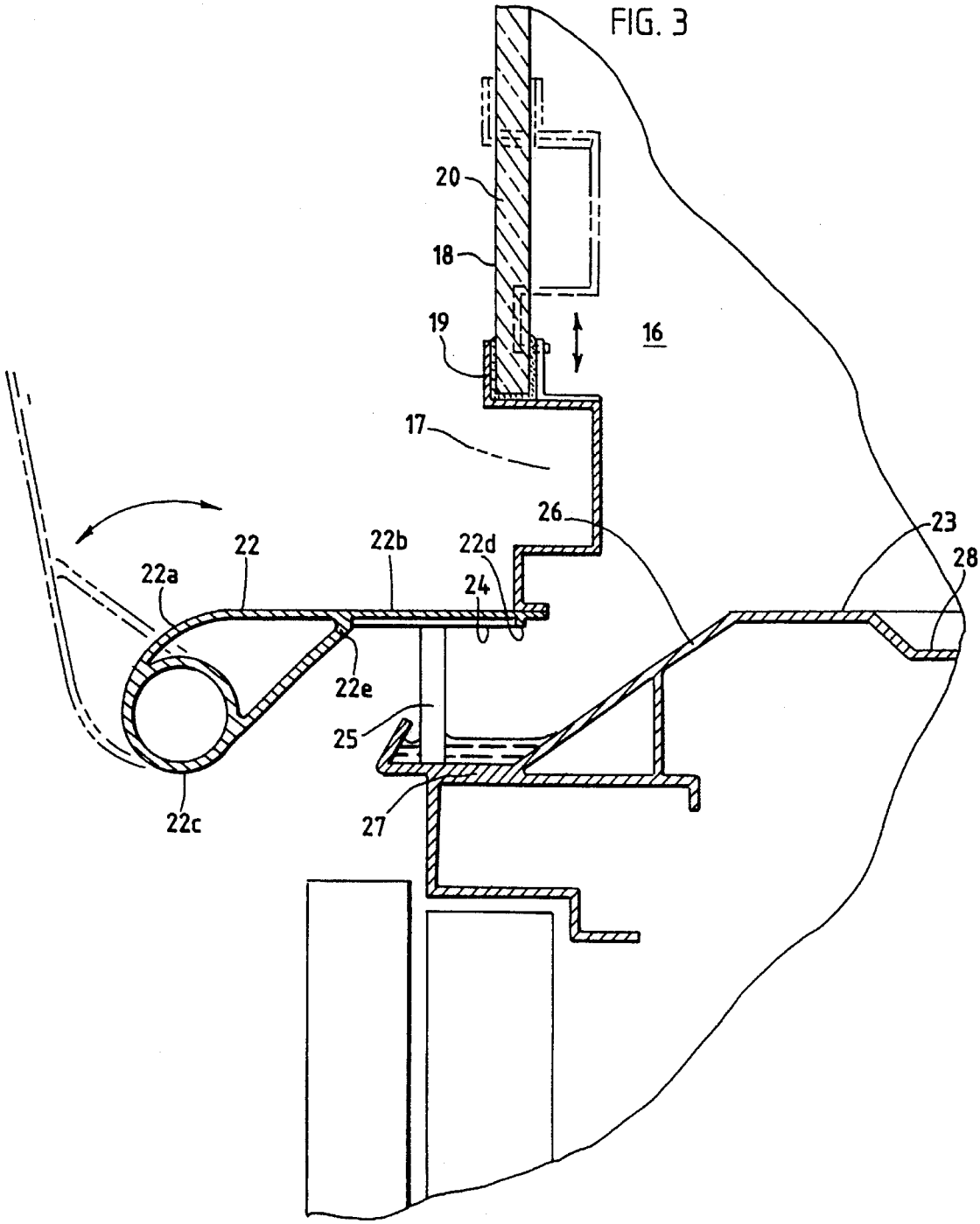
FIG. 3 is a sectional view taken along line 3—3 in FIG.

Turning now to the drawings, FIGS. 1–3 show the fume hood apparatus of the present invention at 10. This fume hood apparatus generally includes a housing with a base member 11 and an enclosure 12 comprising a cover or top 13 and sidewalls having a first end panel 14, a second end panel (not shown) opposite the first end panel, a front panel 15 and a back panel (not shown) opposite the front panel. These components, as well as those described below, are made of metal or any other material of high strength and rigidity.

The enclosure 12 defines a work space 16 and an access opening 17 through which an operator may reach into the work space. A moveable sash 18 lies slidably mounted to the enclosure 12 for closing the opening 17 and thus precluding access to the work space 16. It includes a frame 19 and a glass panel 20. The operator may raise the sash to allow access through the opening 17 (shown in phantom lines in FIG. 3) or lower it to close the opening (shown in solid lines in FIG. 3).

A baffle system 21 disposed in the housing 12 cooperates with a fan (not shown) to evacuate the fumes generated in the work space 16. The baffle system lies at the back of the work space 16 and directs the fumes to a discharge conduit (not shown). As the fan draws the air and fumes out of the work space 16, ambient air flows into the space, primarily through the opening 17. An air foil member 22 directs the incoming air as described below to facilitate evacuation of the work space 16.

The air foil member 22 lies at the bottom of the opening 17 rotatably mounted to the housing 12. It extends the length of the opening 17, and an operator may move it from a first position shown in solid lines in FIG. 3 to a position shown in phantom in that figure. In the first position the air foil member 22 directs air into the work space 16. In the other position shown, it allows better access to the work space 16 and surrounding area for clean up and other operations.

Air flows over and under the air foil member 22. The member 22 has an aerodynamic shape which facilitates the movement of air. When the member 22 lies in the first position and the sash 18 lies open (as shown in phantom lines in FIG. 3), air flows over and under the member 22 and into the work space 16. When the member 22 lies in the first position and the sash 18 lies closed (as shown in solid lines in FIG. 3), air flows under the member 22 and into the work space 16.

The air foil member 22 includes a rounded portion **22*a* and a flat portion 22*b*. The rounded portion lies between the flat portion 22*b* and a tube portion 22*c* that rotatably mounts the member 22 to the enclosure 12. (The tube portion 22*c* may receive enclosure protuberances that function as an axle at the ends of the member 22; or the tube portion 22*c* may be slightly longer than the other portions of the member 22 so that its end portions may extend into pockets in the enclosure 12.) When the member 22 lies in the first position (shown in solid lines in FIG. 3), the top surface of the flat portion 22***b* is flush or co-planar with the fume hood's work surface 23. As stated above, this arrangement allows incoming air to move fumes and other waste off of the work surface 23 and to the back of the work space 16 where the fan can discharge them from the fume hood.

A shelf 24 supports the air foil member 22 in the first position and acts as a stop to prevent further clock-wise rotation of the member 22. This shelf 24 fits snugly between a rib 22*d* and a wall portion 22*e* of the member 22; and it rests on pins 25 (only one pin 25 shown in FIG. 3) which lie on a top segment 26 of the base member 11 at predetermined intervals along the length of the shelf 24. (The shelf 24 is co-extensive with the air foil member 22.)

The top segment 26 of the base member 11 is a plate-like structure which defines the work surface 23. It also defines a trough 27 generally disposed below the shelf 24 and another trough 28 disposed inwardly of the trough 27. These troughs 27 and 28 collect liquid run-off from the work surface 23; and they discharge their contents into discharge conduits (not shown).

The construction of the present invention allows easy operation of the fume hood by operators, including people with disabilities. The sash 18 opens and closes as shown in FIG. 3; and the air foil member 22 rotates in and out of the first position, allowing easy cleaning of the trough 27 and easy insertion of power cords into the work space. When the sash lies closed and in contact with the air foil member 22 (as shown in FIGS. 2 and 3) an opening 29 cut into the member 22 allows a power cord P or similar device to extend out of the work space 16 and to connect with a power outlet 30.

While the above description and the drawings disclose and illustrate one embodiment, one should understand, of course, that the invention is not limited to this embodiment. Those skilled in the art to which the invention pertains may make modifications and other embodiments employing the principles of this invention, particularly upon considering the foregoing teachings. For example, although the embodiment described above includes flat sidewalls and a rectangular work space, the fume hood may have a rounded work space and rounded sidewalls. In addition, the shelf supporting the air foil member need not be continuous and co-extensive with the air foil.

Therefore, by the appended claims, the applicant intends to cover any modifications and other embodiments as incorporate those features which constitute the essential features of this invention.

What is claimed is:

1. A fume hood apparatus comprising: a base member that defines a substantially flat work surface; sidewalls; and a cover; said base member, sidewalls and cover defining an enclosed work space and an access opening; said apparatus including a moveable sash for closing the opening, a moveable air foil member for directing air flow through the opening and into the work space; and means for mounting the air foil proximate an edge portion of the opening and allowing it to move between a first and second position; said air foil member including a flat portion, the flat portion having a surface that lies substantially flush with the work surface when the air foil lies in the first position.

2. The fume hood apparatus of claim 1, wherein the means for mounting the air foil member mounts the air foil so that it rotates between the first and second positions.

3. The fume hood apparatus of claim 1, wherein the base member includes a substantially horizontal top segment which defines the work surface and trough means for collecting liquid flowing off the work surface.

4. The fume hood apparatus of claim 3, wherein the trough means includes an elongate trough disposed along the opening of the apparatus.

5. The fume hood apparatus of claim 4, wherein the trough means includes another trough disposed inwardly of the opening of the apparatus.

6. The fume hood apparatus of claim 1, wherein the base member includes stop means for engaging and supporting the air foil member in the first position.

7. The fume hood apparatus of claim 6, wherein the moveable sash engages the air foil member when the air foil member lies in the first position to close the opening of the apparatus.

8. A fume hood apparatus comprising: a base member that defines a substantially flat work surface; sidewalls; and a cover; said base member, sidewalls and cover defining an enclosed work space and an access opening; said apparatus including a moveable sash for closing the opening, an air foil member for directing air flow through the opening and into the work space, and means for rotatably mounting the air foil proximate an edge portion of the opening and allowing it to move between a first and second position; said air foil member including a rounded portion and a flat portion, the flat portion extending generally inwardly of the work space and a surface of the flat portion being substantially flush with the work surface when the air foil lies in the first position, the flat portion extending away from the work space when the air foil lies in the second position; said base member including a substantially horizontal top segment which defines the work surface and trough means for collecting liquid flowing off the work surface.

9. The fume hood apparatus of claim 8, wherein the trough means includes an elongate trough disposed along the opening of the apparatus.

10. The fume hood apparatus of claim 9, wherein the trough means includes another trough disposed inwardly of the opening of the apparatus.

11. The fume hood apparatus of claim 8, wherein the base member includes stop means for engaging and supporting the air foil member in the first position.

12. The fume hood apparatus of claim 11, wherein the moveable sash engages the air foil member when the air foil member lies in the first position to close the opening of the apparatus.

13. A fume hood apparatus comprising: a base member that defines a substantially flat work surface; sidewalls; and a cover; said base member, sidewalls and cover defining an enclosed work space and an access opening; said apparatus including a moveable sash for closing the opening and an air foil member mounted proximate an edge portion of the base member for directing air flow through the opening and into the work space; a portion of the air foil normally extending through the opening, inwardly of the work space, a predetermined distance above the edge portion of the base member to divide the access opening into top and bottom portions and having a surface that lies substantially flush with the work surface of the base member.

* * * * *